US006340859B1

(12) United States Patent
Lee et al.

(10) Patent No.: US 6,340,859 B1
(45) Date of Patent: Jan. 22, 2002

(54) COLD CATHODE ELECTRON EMISSION DEVICE FOR ACTIVATING ELECTRON EMISSION USING EXTERNAL ELECTRIC FIELD

(75) Inventors: Jung-Yong Lee; Byoung Lyong Choi, both of Seoul (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/248,122

(22) Filed: Feb. 11, 1999

(30) Foreign Application Priority Data

Feb. 11, 1998 (KR) ..... 98-4047
Feb. 18, 1998 (KR) ..... 98-4929

(51) Int. Cl.[7] ..... H01J 1/02; H01J 1/16; H01J 19/10; H01J 1/62; H01J 63/04

(52) U.S. Cl. ..... 313/309; 313/336; 313/351; 313/495; 313/326; 313/392; 313/411; 257/10; 257/11

(58) Field of Search ..... 313/307, 309, 313/336, 351, 495, 326, 392, 411, 446–447, 444, 458, 499, 311–312, 512; 315/169.1, 169.3, 167; 257/10–11, 133, 341; 345/74; 445/50–51

(56) References Cited

U.S. PATENT DOCUMENTS 4,303,930 A * 12/1981 Van Gorkom et al. ..... 257/10
4,486,766 A * 12/1984 Shannon ..... 257/269
5,430,348 A * 7/1995 Kane et al. ..... 313/309
5,444,328 A * 8/1995 Van Zutphen ..... 313/446
5,550,435 A * 8/1996 Kuriyama et al. ..... 313/309 X
5,572,041 A * 11/1996 Betsui et al. ..... 313/309 X
5,631,196 A * 5/1997 Kane et al. ..... 313/309 X
5,861,638 A * 1/1999 Oh et al. ..... 257/133

FOREIGN PATENT DOCUMENTS

JP 10-12166 1/1998

* cited by examiner

*Primary Examiner*—Vip Patel
*Assistant Examiner*—Mack Haynes
(74) *Attorney, Agent, or Firm*—Sughrue Mion, PLLC

(57) ABSTRACT

A cold cathode electron emission device activating electron emission applying an external electric field is provided, in which an inversion layer inverting the type of a semiconductor layer by an external electric field is generated to form a shallow channel, and an electron beam due to a number of electrons is emitted by an avalanche breakdown in the shallow channel. A single or plurality of active regions are formed in the upper portion of the semiconductor substrate in fabrication and then an inversion layer is formed by the external electric field. The cold cathode electron emission device is driven according to the principle that a number of electrons are emitted by the avalanche breakdown in the inversion layer. Thus, since the high-density electrons are instantaneously emitted at the inversion layer by the external electric field, a preheating is not required. As a result, the cold cathode electron emission device can be applied to a variety of fields such as a cathode ray tube (CRT), a field emission display (FED), a microwave device, an e-beam lithography, a laser and a sensor. Also, when a logic circuit, a signal processing circuit and a memory device are integrated together with the cold cathode electron emission device on a semiconductor substrate, various high efficiency devices and circuits can be fabricated which are light, thin, short and small.

9 Claims, 5 Drawing Sheets

COLD CATHODE ELECTRON EMISSION DEVICE FOR ACTIVATING ELECTRON EMISSION USING EXTERNAL ELECTRIC FIELD

BACKGROUND OF THE INVENTION

1. Field of the Invention

The present invention relates to an electron emission device and more particularly, to a cold cathode which instantaneously emits high-density electrons depending upon applied electric field.

2. Description of the Related Art

Cathode ray tubes (CRTs) and so on which are generally used as display devices, use a thermionic cathode which is preheated to emit electrons therefrom. Alternatively, according to the recent development of electronics technology and semiconductor processing technology, cold cathode emission is under study, which lowers the work function of electron emission metal by an externally applied electric field and thus emits electrons instantaneously without preheating.

FIG. 1 illustrates a conventional cold cathode device. As illustrated, the conventional cold cathode includes a p-type substrate 11. A $p^+$ region 12 is formed at the upper portion of the p-type substrate 11 and an $n^+$ region 13 is formed at the neighborhood of the $p^+$ region 12 and in the space formed from the $p^+$ region 12.

Then, above the $p^+$ region is formed an $n^{++}$ shallow channel 14 which is connected with the $n^+$ region 13, centered on the $p^+$ region 12. The $n^{++}$ shallow channel 14 contains a large amount of electrons by means of doping processes and so on. Above the $n^{++}$ shallow channel 14 is located an anode 20 at a predetermined distance from the top of the $n^{++}$shallow channel 14. The emitted electrons collide with the anode 20 and are absorbed therein.

The p-type substrate 11 which is made of crystalline bulk materials should be cut thin and trimmed, and if required, growing of an epitaxial layer having a good crystalline structure is preferred. Then, doping for adding impurities thereto, lithography, deposition and etching are repeated to form the $p^+$ region 12, the $n^{++}$ region 13 and the $n^+$ +shallow channel 14 in sequence. The $n^{++}$ shallow channel 14 is a region for enhancing an electron emission efficiency and is a channel which is less than or equal to about 300 Å(that is, $10^{-10}$ m) in thickness in the form of a thin plate. Here, a symbol "+" in $p^+$, $n^+$, and $n^{++}$ indicates impurity concentration contained in host materials.

In the above conventional electron emission device, a voltage $V_A$ is applied between the $n^+$ region 13 and the anode 20 and a voltage $V_B$ is applied between the $n^+$ region 13 and the p-type substrate 11. The voltage $V_A$ is applied to emit electrons from the surface of the $n^{++}$ shallow channel 14 and is a high voltage of about 400–500 volts, which can be adjusted according to the features and degree of vacuum of the electron emission device, and the kind of the semiconductor material used in the fabrication. The voltage $V_B$ is applied to a pn junction formed by the $p^+$ region 12 and the $n^{++}$ shallow channel 14 and is a voltage of about 5–10 volts. As shown in FIG. 1, if the voltage $V_B$ is applied between the $n^+$ region 13 and the p type substrate 11, the pn junction of the $n^{++}$ shallow channel 14 and the $p^+$ region 12 is reversely biased and an avalanche breakdown occurs in the $n^{++}$ shallow channel 14. The avalanche breakdown means that a large number of electrons which are newly produced by successive collision of electrons due to an applied reverse bias in a highly doped host material contribute to electrical conduction. Thus-produced large number of electrons are accelerated to have energy exceeding the work function of the host material which is a material of the $n^{++}$ shallow channel 14 and emitted in vacuum. Here, if the upper surface of the $n^{++}$ shallow channel 14 is gilded with a material having a small work function, electrons are emitted although a forward bias voltage is applied between the p-type substrate 11 and the $n^+$ region 13.

In the case of the above conventional cold cathode device, the upper surface of the $n^{++}$ shallow channel 14 should be gilded with a material having a small work function such as cesium (Cs) in order to efficiently emit a large number of electrons, although the $n^{++}$ shallow channel 14 for emitting electrons has been physically fabricated with the high doping state. However, since the above surface gilded material is evaporated together with the emitted electrons, it is difficult to maintain the initial surface gilded state. Moreover, a high degree of vacuum of about $10^{-9}$–$10^{-11}$ torr should be maintained between the $n^{++}$ shallow channel 14 and the anode 20, which is also a very difficult matter to achieve.

Also, in the case of the above conventional cold cathode device, the area of the electron emitting portion is small in comparison to the whole area of the device, and thus the number of the emitted electrons is small and the use efficiency of the electron emission area is low. In this case, the electron emission area can be enlarged in fabrication. However, the electron emission area is increased, but the number of the emitted electrons not. Moreover, a surface processing and degree of vacuum is further required in order to increase the electron emission efficiency.

SUMMARY OF THE INVENTION

To solve the above problems, it is an object of the present invention to provide a cold cathode electron emission device activating electron emission by applying an external electric field, in which a single active region or a plurality of active regions are formed in the upper portion of a substrate, and high-density electrons are emitted by forming a shallow channel with an inversion layer electrically generated by the external electric field, and driving the shallow channel so that a Schottky effect and avalanche breakdown occur therein.

It is another object of the present invention to provide a cold cathode electron emission device activating electron emission by applying an external electric field, in which a shallow channel being an inversion layer is physically formed but is fabricated so that a number of active regions should be located below the shallow channel, to thereby emit high-density electrons by a number of active regions.

To accomplish the one object of the present invention, there is provided a cold cathode electron emission device activating electron emission by appliyng an external electric field, the cold cathode electron emission device comprising: a first type substrate which is a base of the electron emission device; at least one first type active region which is formed in the upper portion of the substrate and has a predetermined alignment pattern; a second type contact region which is formed in the upper portion of the substrate to surround the active region, around and spaced from the active region; and a gate region which is formed in the upper portion of the contact region at the state electrically insulated from the contact region, wherein a second type inversion layer is electrically formed on and around the upper portion of the active region by a voltage applied between the gate region and the substrate.

To accomplish the other object of the present invention, there is also provided a cold cathode electron emission device activating electron emission by appying an external electric field, the cold cathode electron emission device comprising: a first type substrate which is a base of the electron emission device; at least two first type active regions which are formed in the upper portion of the substrate; a second type contact region which is formed in the upper portion of the substrate to surround the active region, on and around and spaced from the active region; and a second type inversion layer connected with the contact region around the upper portion of the active region.

BRIEF DESCRIPTION OF THE DRAWINGS

The above objects and other advantages of the present invention will become more apparent by describing the preferred embodiment thereof in more detail with reference to the accompanying drawings in which.

DETAILED DESCRIPTION OF THE PREFERRED EMBODIMENTS

The present invention is characterized in fabrication and generation of a shallow channel representing the feature of an inversion layer and the layer structure of a single or plurality of active regions formed in the lower portion of the inversion layer. That is, the first structure is characterized in that an inversion layer is electrically formed by an electric field applied in operation of the electron emission device, in which a single or a plurality of active regions are located in the lower portion of the inversion layer. The other structure is characterized in that an inversion layer is physically formed in fabrication of the electron emission device but a number of active regions are located in the lower portion of the inversion layer, to thereby enhance an electron emission efficiency.

Preferred embodiments of the present invention will be described with reference to the accompanying drawings.

Figure 1:
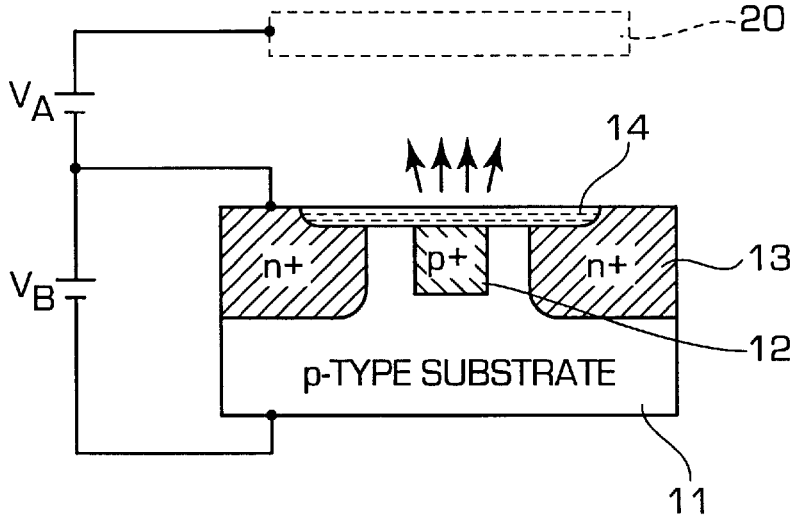
FIG. 1 illustrates a conventional cold cathode device.
Figure 2:
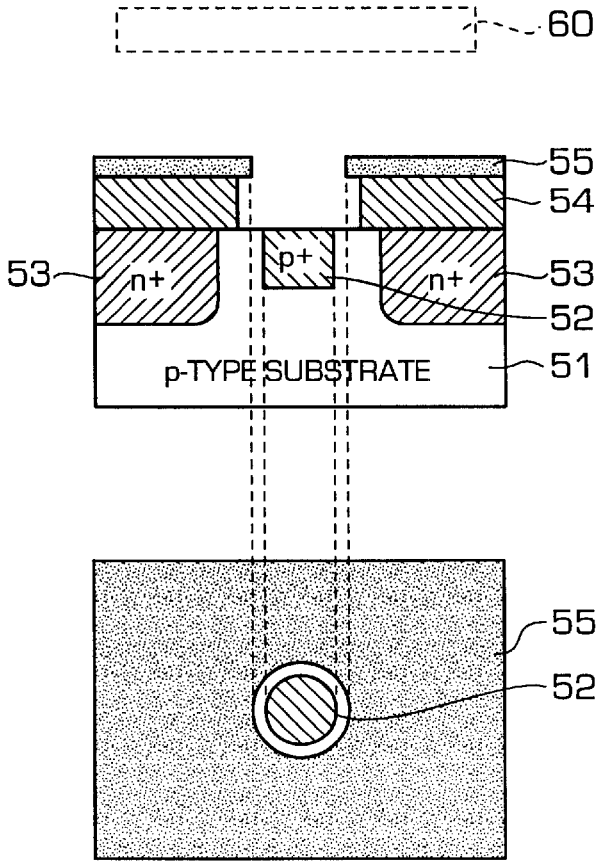
FIG. 2 shows the structure of a cold cathode electron emission device forming an inversion layer by an electric field according to the present invention.
Figure 3:
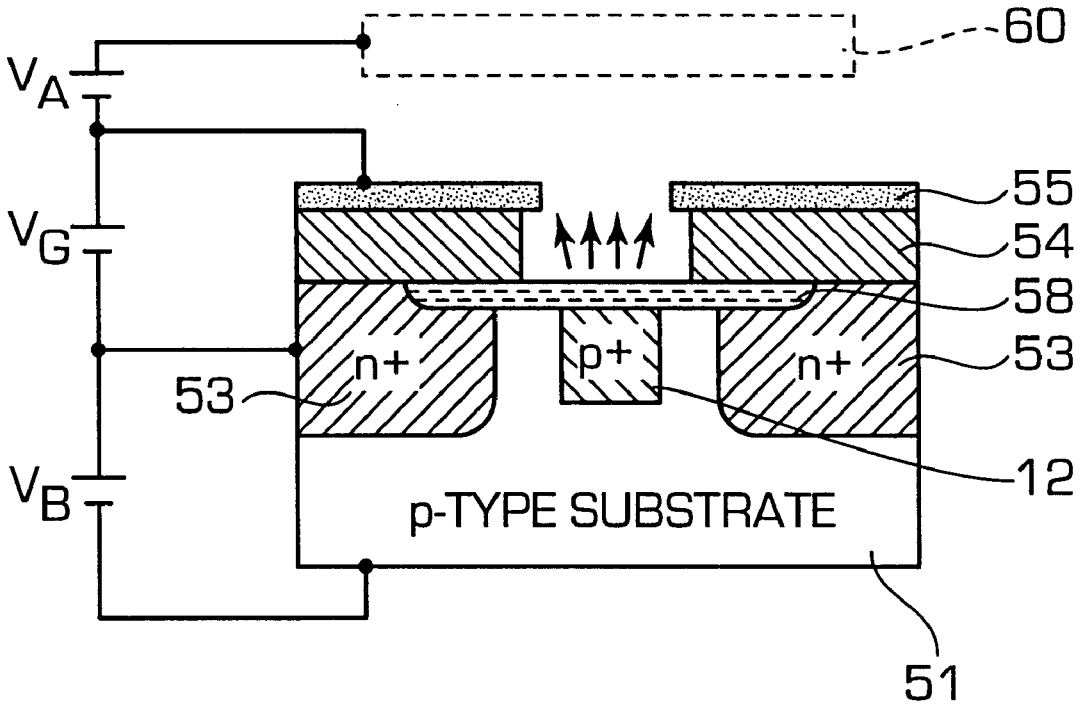
FIG. 3 shows a diagram explaining a power applying method in order to describe the operation of the cold cathode electron emission device according to the present invention.

FIG. 2 shows the structure of a cold cathode electron emission device activating electron emission by applying an external electric field according to a first embodiment of the present invention. FIG. 3 shows a diagram explaining a power applying method in order to describe the operation of the cold cathode electron emission device.

In the cold cathode electron emission device shown in FIG. 2, a $p^+$ active region 52 is formed in the upper portion of a p-type substrate 51 which is a base of device fabrication, and then $n^+$ region 53 is formed around the $p^+$ active region 52. Then, an insulation layer 54 is formed so that the upper portion of the $p^+$ active region 52 is open and a gate layer 55 is formed in the upper portion of the insulation layer 54. A collision absorption portion 60 being an anode is formed at a predetermined distance from the upper portion of the gate layer 55, so that the beam of the emitted electrons has a given directionality.

Referring to FIG. 3, voltages $V_A$ and $V_B$ are the same as those described before, and a voltage $V_G$ is applied between the gate layer 55 and the $n^+$ contact region 53, and is a voltage of about 300 volts. The voltage $V_G$ is used for electrically generating a shallow channel, such a conventional shallow channel which is physically formed in fabrication of the electron emission device. The beam of the electrons emitted from the electrical shallow channel can be efficiently controlled by adjusting the voltage $V_G$. Also, the voltage $V_G$ can be adjusted to effectively generate the shallow channel 58, which is an electrical inversion layer, and efficiently control the emitted electrons.

In the cold cathode electron emission device according to the present embodiment, the total electrical potential difference $V_G+V_B$ between the gate layer 55 and the p-type substrate 51, generate an $n^{++}$ inversion layer 58 in which the physical properties of the semiconductor material of the $p^+$ active region 52, the p-type substrate of the substrate 51 around the $p^+$ active region 52, and the $n^+$ contact region 53 are varied.

Figure 4:
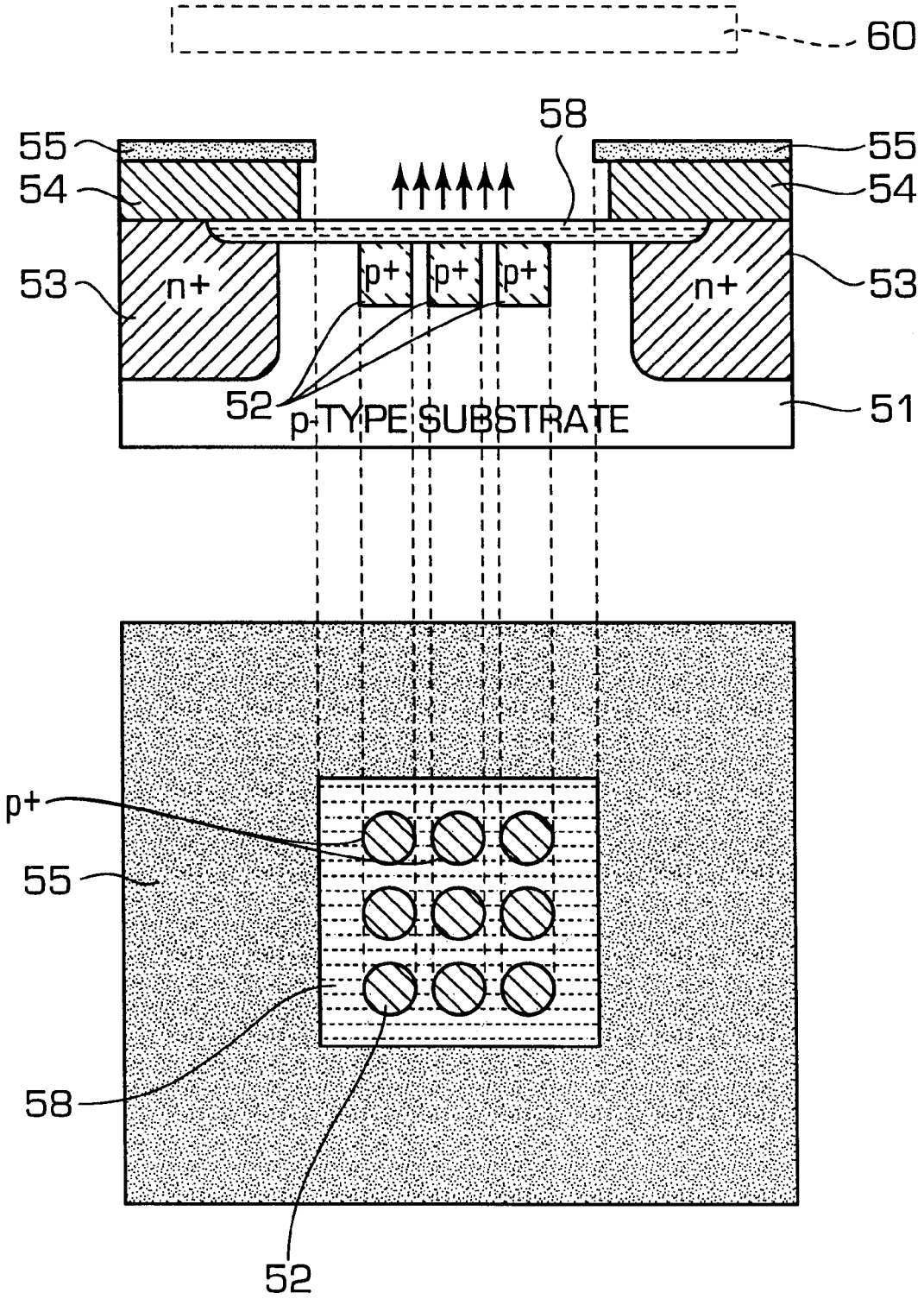
FIGS. 4 and 5 illustrate a preferred embodiment of the contact region electron emission device according to the present invention, respectively.
Figure 5:
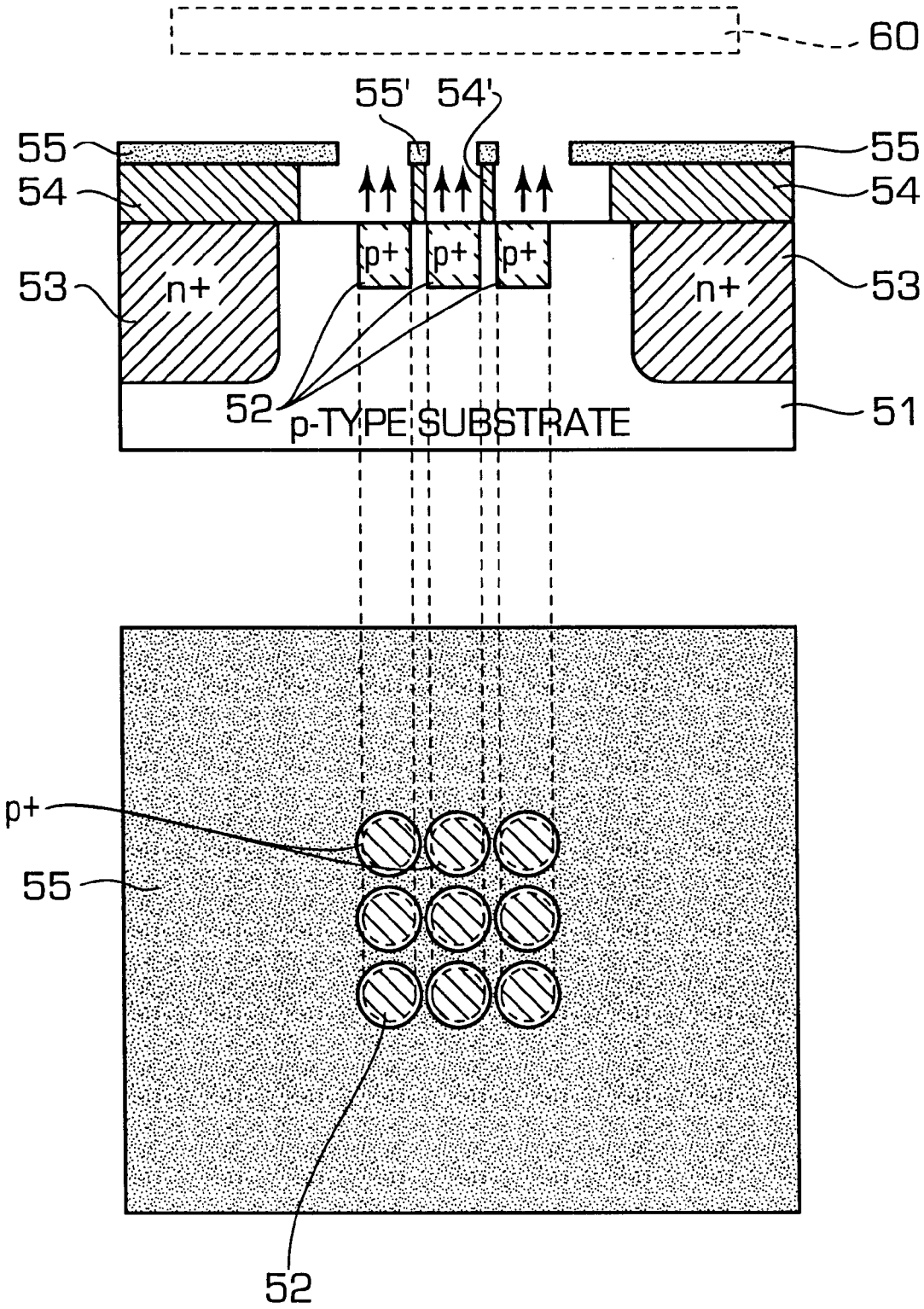

FIGS. 4 and 5 illustrate the cold cathode electron emission device according to a second embodiment of the present invention, respectively. Referring to FIG. 4, a plurality of $p^+$ active regions are formed in the upper portion of the substrate and a shallow channel is physically formed in the upper portion of the $p^+$ active regions. Referring to FIG. 5, a plurality of $p^+$ active regions are formed in the upper portion of the p-type substrate and an external electric field (voltage) is applied thereto, to thereby generate a shallow channel electrically.

In the cold cathode electron emission device shown in FIG. 4, a plurality of $p^+$ active regions 52 are formed in parallel with each other in the upper portion of the p-type substrate 51, so that the plurality of the $p^+$ active regions 52 have a certain interval and pattern. The $n^+$ contact region 53 is formed around the plurality of the $p^+$ active regions 52 in order to apply power thereto. The shallow channel 58 of the $n^{++}$ inversion layer which is physically formed in such a doping processing is connected with the $n^+$ contact region 53, on and around the upper portion of the $p^+$ active regions 52. Also, insulation layer 54 is formed to be insulated from the shallow channel 58 and the $n^+$ contact region 53. The gate layer 55 is formed in the upper portion of the insulation layer 54. Also, a collision absorption portion 60 is formed spaced by a predetermined distance from the gate layer 55.

In the structure of the cold cathode electron emission device shown in FIG. 4, since the shallow channel 58 of the $n^{++}$ inversion layer is formed physically at the upper portion of the $p^+$ active regions 52, both the insulation layer 54 and the gate layer 55 can be omitted.

In the above-described cold cathode electron emission device of FIG. 5, plurality of the $p^+$ active regions 52, to form the shallow channel 58 of the $n^{++}$ inversion layer. Thus, the electron emission device of FIG. 5 different from the structure of FIG. 4 does not form the $n^{++}$ inversion layer 58 physically in fabrication. In addition, the electron emission device of FIG. 5 is similar to the structure of FIG. 4, but an insulation layer 54' and a agate layer 55' are formed between the $p^+$ active regions. That is, the upper portion of each of the $p^+$ active regions is open, so that the shallow channel of the $n^{++}$ inversion layer an be effectively generated by an external electric field (voltage).

The power applying method of the electron emission device shown in FIG. 4 or 5 is the same as that described above. When the electron emission device is fabricated in the form where both the insulation layer 54 and the gate layer 55 are omitted in the FIG. 4 structure, the voltage $V_C$ applied to the gate layer 55 should be omitted. The operation of the electron emission device FIG. 4 or 5 is the same as that of described referring to FIG. 3. In particular, since the plurality of the $p^+$ active regions 52 are formed, the high-density electrons exist in the physical or electrical shallow channel in operation of the electron emission device. Accordingly, the efficiency of the electron emission is further increased. Also, the magnitude of the applied voltage is lowered to some degree.

The collision absorption portion 60 spaced from the gate layer 55 enhances the electron emission efficiency and allows the electron beam of the emitted electrons to have a directionality. When a display device is fabricated using the cold cathode electron emission device according to the present embodiment, a fluorescent material io coated on the collision absorption portion 60 used as a collector, in order to form a picture thereon. Also, when a material having a large band-gap energy (Eg) and a small work function is coated on the upper portion of the $p^+$ active region 52, an electron emission efficiency is increased.

In the case of the cold cathode electron emission device of the present embodiment, the $p^+$ active region 52, the insulation layer 54 and the gate layer 55 can be fabricated in various forms in order to increase the efficiency of the electron emission. That is, if the $p^+$ active region 52 is formed in rectangular shape, the $n^+$ contact region 53 formed around the $p^+$ active region 52 can be fabricated in similar form to a degree for efficient operation, and the insulation layer 54 and the gate layer 55 can be fabricated similarly in various forms.

Figure 6:
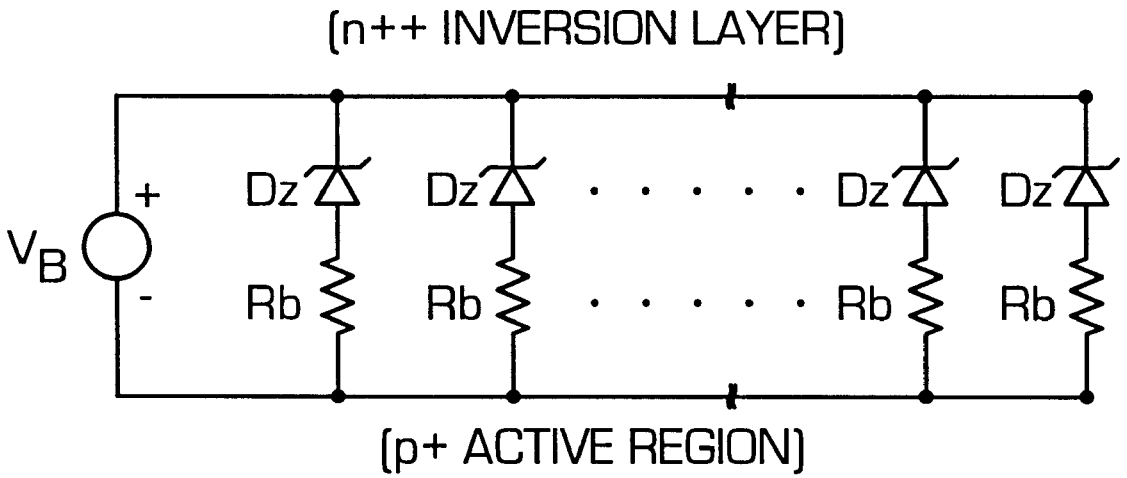
FIG. 6 is an equivalent circuit diagram illustrating the operational characteristics of the cold cathode electron emission devices shown in FIGS. 4 and 5.

FIG. 6 is an equivalent circuit diagram illustrating the operational characteristics of the cold cathode electron emission devices shown in FIGS. 4 and 5. Diodes Dz represent a plurality of pn junction equivalent diodes formed by the shallow channel of the $n^{++}$ inversion layer and the plurality of the $p^+$ active regions 52, and resistors Rb each represent an equivalent resistance of each pn junction.

As illustrated, the operation of the pn junction by the shallow channel 58 and the plurality of the $p^+$ active regions 52 represents the same operational characteristics as those when a plurality of equivalent diode-resistor pairs are connected in parallel to each other in each pair of which one equivalent diode Dz and one equivalent resistor Rb are connected in series. Thus, the operational resistance of the whole cold cathode electron emission device is decreased to an extremely small value. As a result, the efficiency of the electron emission is further increased. Although some $p^+$ active regions 52 are not activated due to the error in the fabrication and operational process, the other $p^+$ active regions 52 operate. Thus, the efficiency of the electron emission device is reduced slightly but does not influence the whole operation. As described above, the present invention emits the high-density electrons by forming a shallow channel of an inversion layer by a single or plurality of active regions and an external electric field in operation.

Moreover, when the cold cathode electron emission device of the present invention operates together with a logic circuit, a memory device and a power supply circuit, on the lower substrate or the rear surface of the substrate, an operational efficiency is increased and it is possible to fabricate the device in the light, thin, short and small forms and high functions. Also, the cold cathode electron emission device can be applied to various fields including an optical sensor or a field emission device (FED), etc.

What is claimed is:

1. A cold cathode electron emission device which activates electron emission by applying an external electric field, the cold cathode electron emission device comprising:

a substrate of a first conductivity type which is a base of the electron emission device;

at least one active region of the first conductivity type which is formed in the upper portion of the substrate and has a predetermined alignment pattern;

a contact region of a second conductivity type which is formed in the upper portion of the substrate to surround the active region, and spaced from the active region; and a gate region which is formed in the upper portion of the contact region electrically insulated from the contact region, the active region being operable to form an inversion layer of the second conductivity type disposed on and around the upper portion of the active region, upon application of a voltage between the gate region and the substrate.

2. The cold cathode electron emission device according to claim 1, wherein the upper portion of said at least one active region is surface-processed with a material having a high electron emission efficiency.

3. The cold cathode electron emission device according to claim 1, further comprising an electron collision absorption layer which is formed spaced apart from the upper portion of said gate layer at a certain distance wherein said emitted electrons collide with the electron collision absorption layer and are absorbed therein.

4. The cold cathode electron emission device according to claim 3, wherein the surface of said collision absorption layer is coated with a fluorescent material.

5. A cold cathode electron emission device which activates electron emission by applying an external electric field, the cold cathode electron emission device comprising:

a substrate of a first conductivity type which is a base of the electron emission device;

at least two active regions of the first conductivity type which are formed in the upper portion of the substrate;

a contact region of a second conductivity type which is formed in the upper portion of the substrate to surround the active region, and spaced from the active region; and a inversion layer of the second conductivity type connected with the contact region on and around the upper portion of the active region.

6. The cold cathode electron emission device according to claim 5, wherein the upper portion of said first type active regions is surface-processed with a material having a high electron emission efficiency.

7. The cold cathode electron emission device according to claim 5, further comprising an electron collision absorption layer which is formed space apart from the upper portion of said gate layer at a certain distance wherein said emitted electrons collide with the electron collision absorption layer and are absorbed therein.

8. The cold cathode electron emission device according to claim 7, wherein the surface of said collision absorption layer is coated with a fluorescent material.

9. The cold cathode electron emission device according to claim 5, further comprising a gate layer formed in the upper portion of the contact region electrically insulated from said contact region.

* * * * *